United States Patent [19]

Brotman et al.

[11] Patent Number: 5,048,130

[45] Date of Patent: Sep. 17, 1991

[54] PORTABLE, KNOCKDOWN TOILET KIT

[76] Inventors: Charles J. Brotman, 8103 Kenewick Ave., Takoma Park, Md. 20912; Mark Gottlieb, 3495 Pence Ct., Annandale, Va. 22003

[21] Appl. No.: 553,638

[22] Filed: Jul. 18, 1990

[51] Int. Cl.[5] ..... A47K 11/04

[52] U.S. Cl. ..... 4/483; 4/476; 4/484

[58] Field of Search ..... 4/483, 484, 476, 477, 4/478, 479, 480; 229/23 R, 117.02, 103

[56] References Cited

U.S. PATENT DOCUMENTS 2,912,702 11/1959 MacKenzie ..... 4/476

2,974,321 3/1961 Salka ..... 4/476

4,037,775 7/1977 Bamburg et al. ..... 229/23 R 4,094,454 6/1978 Snyder ..... 229/28 R

*Primary Examiner*—Henry J. Recla

*Assistant Examiner*—David J. Walczak

*Attorney, Agent, or Firm*—Terry M. Gernstein

[57] ABSTRACT

A portable, knockdown toilet includes a top unit and a bottom unit which cooperate with each other to define a carrying case into which a collapsible midunit, a collapsible insert unit, collection bags, and accessories are placed for carrying and storage. A handle is attached to the carrying case. Flexible waste collection bags are included, and a desiccant gel is also included as are bag ties so cleanup is facilitated.

10 Claims, 10 Drawing Sheets

PORTABLE, KNOCKDOWN TOILET KIT

TECHNICAL FIELD OF THE INVENTION

The present invention relates to the general art of water closets, and to the particular field of portable toilets.

BACKGROUND OF THE INVENTION

Outdoor activities, such as camping, picnicking, boating, and the like, have enjoyed increased, and increasing, popularity in recent years. Many of these outdoor activities involve a multitude of people and extend for many hours, even days and longer, in some instances.

The provision of adequate toilet facilities is often an important consideration in planning any outdoor activity. This is not a difficult problem where public facilities are available. However, in many instances, such as on camping trips, such public facilities are not readily available, and appropriate accommodations must be provided.

For this reason, the art has included several proposed designs for portable toilets. While somewhat successful, many of these portable toilets have drawbacks which inhibit the full utilization and commercial success of such designs. For example, many so-called portable toilets are quite large and thus difficult to store, while others are cumbersome to transport, even requiring a truck in some cases. Other so-called portable toilets are difficult to set up, while still others may be quite difficult to collapse or knockdown after use, and others may be too large for use in small areas, such as on boats, campers, or the like.

Therefore, there is a need for a portable toilet which is easily stored and transported, easily set up and knocked down, and can be used in small, confined areas.

OBJECTS OF THE INVENTION

It is a main object of the present invention is to provide a portable toilet which is easily stored and transported.

It is another object of the present invention to provide a portable toilet which is easily stored and transported, easily set up and knocked down.

It is another object of the present invention to provide a portable toilet which is easily stored and transported, easily set up and knocked down, and can be used in small, confined areas.

SUMMARY OF THE INVENTION

These, and other, objects are achieved by a portable, knockdown toilet which collapses into a conveniently stored and carried form resembling a handled briefcase or suitcase, and which includes the suitcase carrying case as part of the set-up toilet. Waste collection bags, desiccant gel, toilet paper and the remaining elements of the toilet are all contained in the carrying case during storage and transport.

The carrying case includes two sections, one of which becomes a top unit of the set-up toilet and the other of which becomes a bottom unit of the set-up toilet, connected together by a fastener element as well as by handle mounting elements. A handle element is attached to the carrying case so the case is easily transported from place to place.

Dovetail-type joints, slot-received projections, and releasable hinges are also included to facilitate set up and knockdown of the toilet. Waste collection bags include desiccating gel and ties so disposal of the collected waste is facilitated.

The toilet is formed of stiff, sturdy materials, such as corrugated cardboard, or the like, which are strong enough to reliably support a heavy user, yet are also light so that transporting the collapsed unit will not be difficult or cumbersome.

In this manner, the portable, knockdown toilet embodying the present invention is easily stored and transported in the manner of a hand-held suitcase, yet is easily set up and knocked down and can be small enough to be used in small, confined areas, yet will be sturdy for reliable use.

BRIEF DESCRIPTION OF THE DRAWING FIGURES

DETAILED DESCRIPTION OF THE PREFERRED EMBODIMENT OF THE INVENTION

Figure 1:
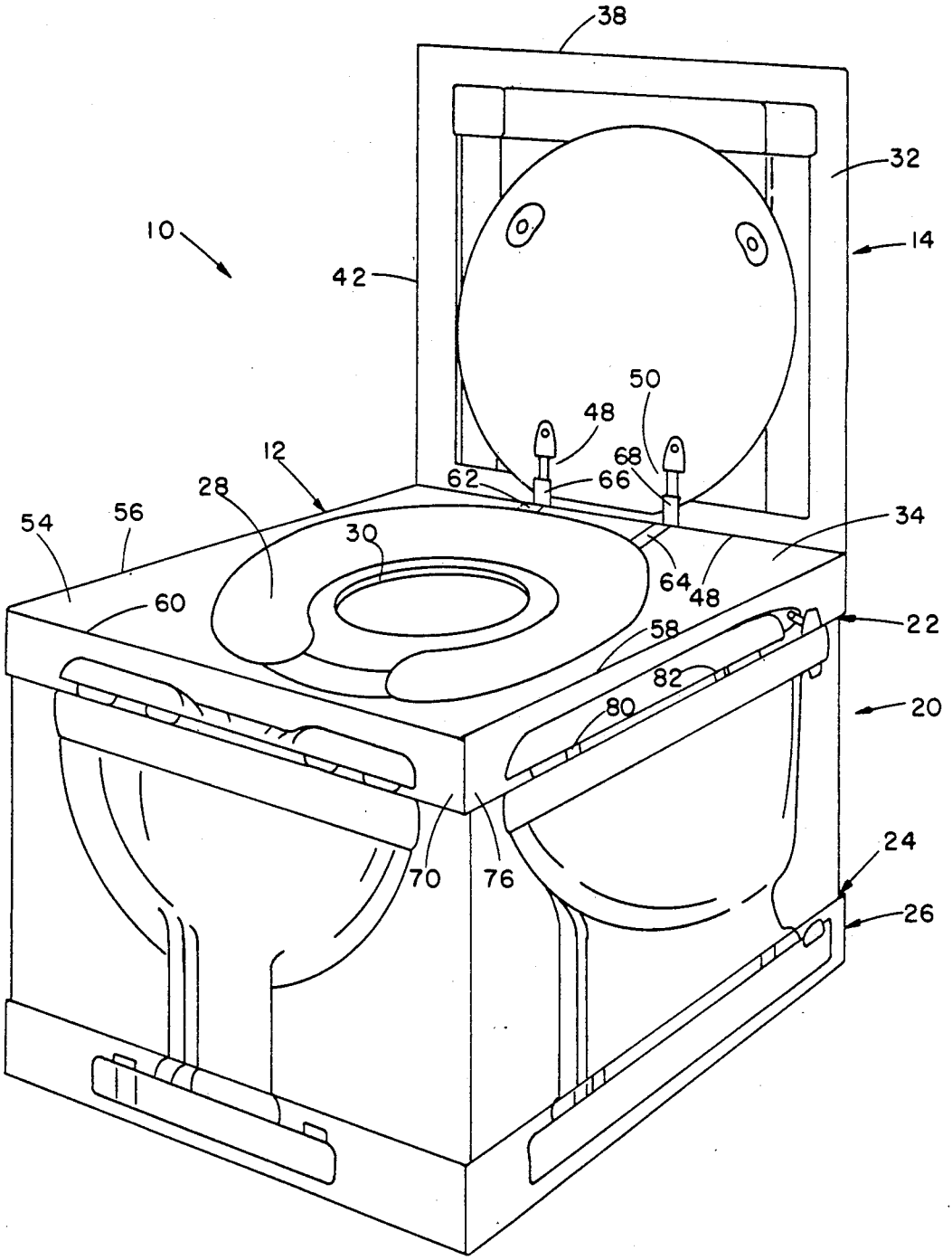
FIG. 1 is a perspective view of a toilet embodying the present invention in the set-up configuration.

Shown in FIG. 1 is a portable, knockdown toilet 10 embodying one form of the present invention in the set-up configuration. The toilet includes a top unit 12 on which a cover 14 is hingeably connected for movement between a covering position in engagement with top surface 16 of the top unit to an open position shown in FIG. 1, a midunit 20 which includes a top portion 22 on which the top unit rests and a bottom portion 24 which is received in a bottom unit 26. Suitable surface decoration, such as seat outline 28 surrounding a hole 30 defined through the top unit can be included as well as desirable advertising, instructions or the like. The toilet is adapted to be knocked down and collapsed into a storage and transporting configuration shown in FIG. 3 from the FIG. 1 configuration. The storage and transport configuration is indicated by reference numeral 10'.

Figure 2:
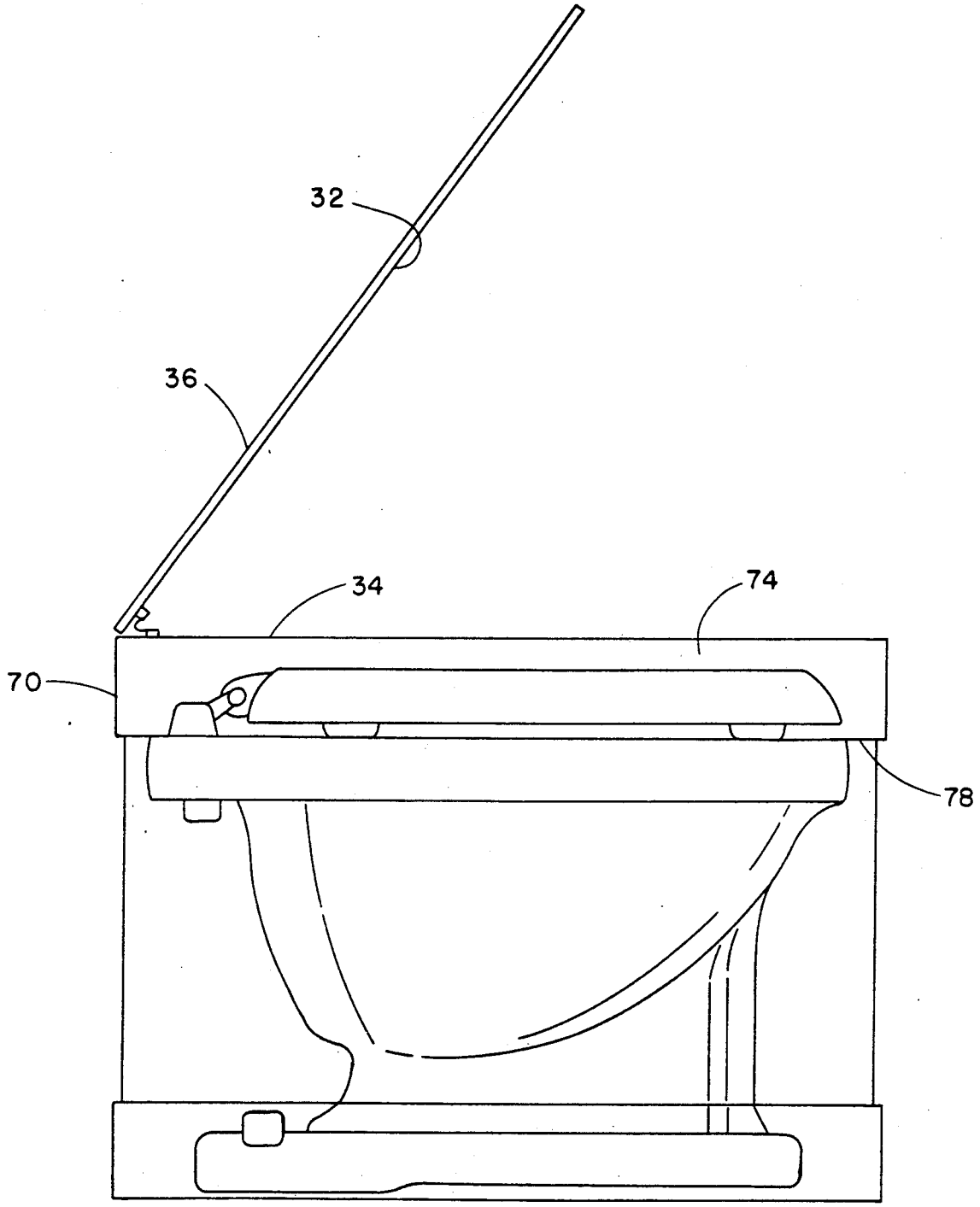
FIG. 2 is a side elevational view of the toilet in the set-up configuration.
Figure 8:
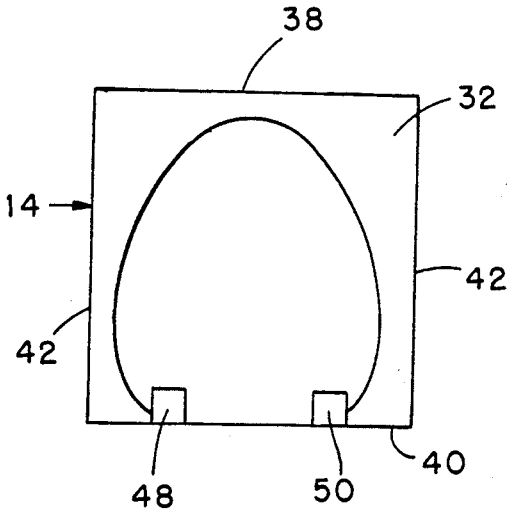
FIG. 8 is a bottom view of a cover element.

The cover unit 14 is best shown in FIGS. 1, 2 and 8, and includes a bottom surface 32 which engages top surface 34 of the top unit when the cover is in the covering position, and a top surface 36 which is presented outwardly and upwardly of the unit in the FIG. 1 and 2 set-up condition. The cover unit 14 is rectangular in peripheral shape and includes a front edge 38, a rear edge 40 and two side edges 42 and 44 which connect the front edge to the rear edge. The rear edge is located closely adjacent to a rear edge 46 of the top unit 12, and two hinges elements 48 and 50 are fixed to the cover unit adjacent to the rear edge 40 thereof.

Figure 7:
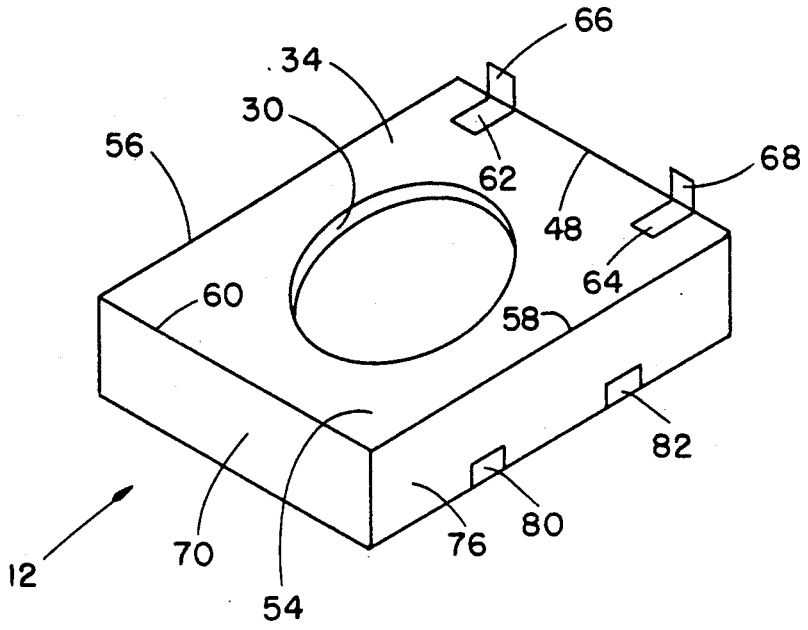
FIG. 7 is a top perspective view of a top unit in a set-up configuration.

The top unit 12 is shown in FIGS. 1, 2 and 7, and includes a rectangular periphery that is essentially equal to the peripheral size of the cover unit. The top unit includes a planar central section 54 having the hole 30 defined therethrough near the center thereof and side edges 56 and 58 connecting rear edge 46 to a front edge 60. Hinge elements 62 and 64 are located on the top surface 34 of the planar central section 54 to be positioned adjacent to the hinge elements 48 and 50 respectively on the cover element to be connected thereto by flexible cables 66 and 68 respectively for connecting the cover unit to the top unit as shown in FIGS. 1 and 2.

The top unit 12 further includes a front flange 70 connected at one side thereof to the front edge 60 of the top unit and depending downwardly therefrom in the set-up configuration shown in FIG. 1, a rear flange 72 connected at one side thereof to the rear edge 46 of the top unit central section to depend downwardly therefrom in the set-up configuration, and two side flanges 74 and 76 which are each connected to top unit central section side edges 56 and 58 respectively to depend downwardly therefrom in the set-up condition shown in FIG. 1. Each of the top unit flanges has a lower edge, such as lower edge 78 of flange 74, which is coplanar with the lower edges of the other flanges. Each of the flanges has an inner surface which cooperates with the inner surface of the adjacent top unit flanges to define an inner peripheral surface area having a top unit inner perimeter dimension for the top unit. The top unit inner perimeter will be discussed below.

Two handle mounting elements 80 and 82 are located on the flange 76 at locations which are spaced apart from each other and from the front and rear edges 60 and 48 respectively. The elements 80 and 82 preferably are hook-and-loop type fastener elements and are used for a purpose that will be discussed below.

Figure 5:
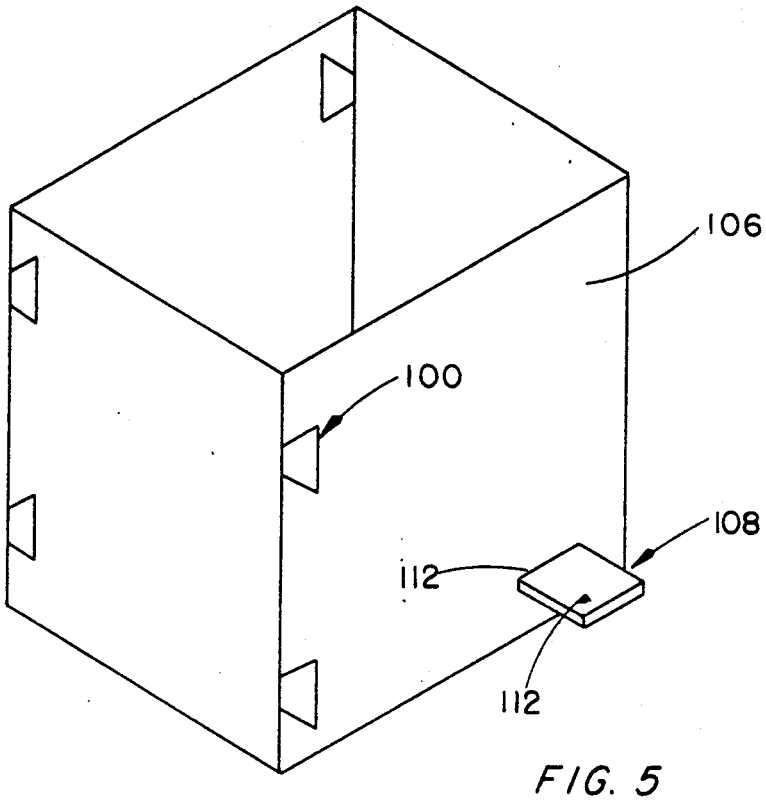
FIG. 5 is a perspective view of a midunit in the set-up configuration.

The midunit 20 is best shown in FIGS. 1, 2, 4 and 5, and attention is now directed to such figures. The midunit is comprised of four sections, three of which are identical to the section 90 shown in FIG. 4. The identical sections are rectangular in peripheral shape and include a side edges 92 and 94 connected together by end edges 96 and 98, with side edge 94 being a bottom edge when the midunit is in the set-up configuration shown in FIG. 5 and in place in the set-up unit shown in FIG. 1. Dovetail-like connecting joints 100 are used to connect adjacent sections together as shown in FIG. 5, and each connecting joint includes a triangular projection 102 extending from edge 98 which is received in a triangular notch 104 defined in edge 96 of the next adjacent section. It is noted that the dovetail-like connections 100 are merely examples of the many different types of connections that can be used, and are not intended to be limiting in any way. The assembled midunit is shown in FIG. 5 with the assembled sections having outer surfaces, such as outer surface 106, cooperating to define an outer perimeter for the midunit. The midunit outer perimeter is less than the inner perimeter of the top unit so that the midunit can be snugly received in the flanges of the top unit as shown in FIGS. 1 and 2.

One of the four sections forming the midunit includes a projection 108 formed of flexible material and connected to the midunit by a living hinge 110 on a proximal end thereof so the projection can move from a stored position having top surface 112 located closely adjacent to the outer surface 106 of the midunit section to the deployed position shown in FIG. 5 with distal end 114 spaced from the outer surface 106. The projection is used to connect the midunit to the bottom unit 26 as will be understood from the ensuing discussion. The set-up midunit defines a tubular sleeve having a rectangular peripheral shape as shown in FIG. 5.

Figure 6:
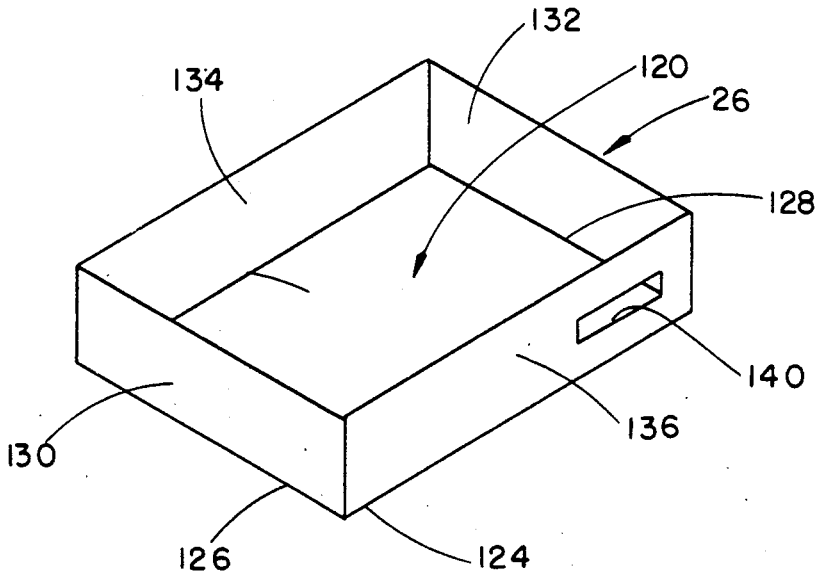
FIG. 6 is a perspective view of a bottom unit in a set-up configuration.

The bottom unit 26 is best shown in FIGS. 1, 2 and 6, and attention is now directed to such figures. The bottom unit 26 includes a central planar section 120 having a rectangular peripheral shape with sides 122 and 124 connecting front edge 126 to rear edge 128. The bottom unit front, rear and side edges all cooperate to define a perimeter that has an extent that is essentially equal to the peripheral extent of the top unit central section and which is in excess of the peripheral extent of the midunit so the midunit can be slipped into the bottom unit and held in place thereby.

The bottom unit also includes a front flange 130 foldably connected to the central section at the front edge 126 thereof, a rear flange 132 foldably connected to the central section at the rear edge 128, a first side flange 134 foldably connected to the central section at the side edge 122, and a second flange 136 foldably connected to the central section along side edge 124. The bottom unit flanges are also connected to adjacent flanges to define an open container into which the midunit is accommodated. The projection 108 is received through a slot 140 defined in the flange 136 to attach the midunit to the bottom unit.

Figure 3:
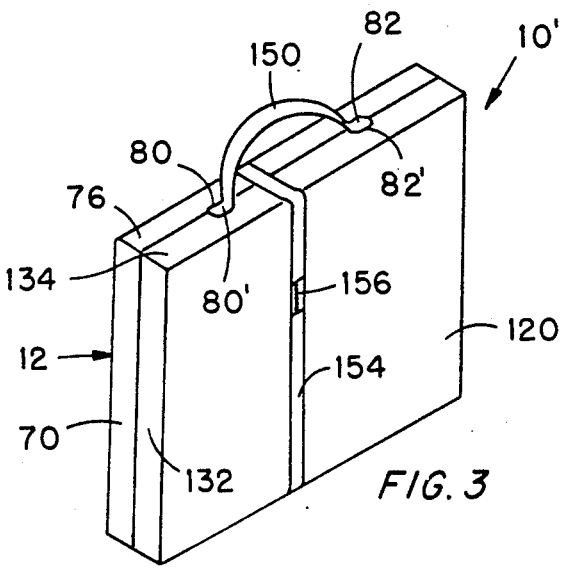
FIG. 3 is a perspective view of the toilet in the knocked down, suitcase-like kit configuration.

The bottom unit further includes two handle mounting elements 80' and 82' similar to the handle mounting elements 80 and 82 on the top unit, with such elements being located on the rear flange 134 in position to form continuations of the handle mounting elements 80 and 82 when the bottom unit flanges are in abutting contact with the top unit flanges and the top and bottom units are in concentric relationship with each other as shown in FIG. 3.

As shown in FIG. 3, a handle element 150 has feet 152 which are releasably attached to the handle mounting elements as by hook-and-loop fastening means on both the handle and on the handle mounting elements. A fastening strap 154 encircles the concentric top and bottom units and includes a releasable buckle element 156, which is formed of hook-and-loop fastening elements on each end of the strap and which cooperate to releasably close the strap about the suitcase configured toilet.

Figure 10:
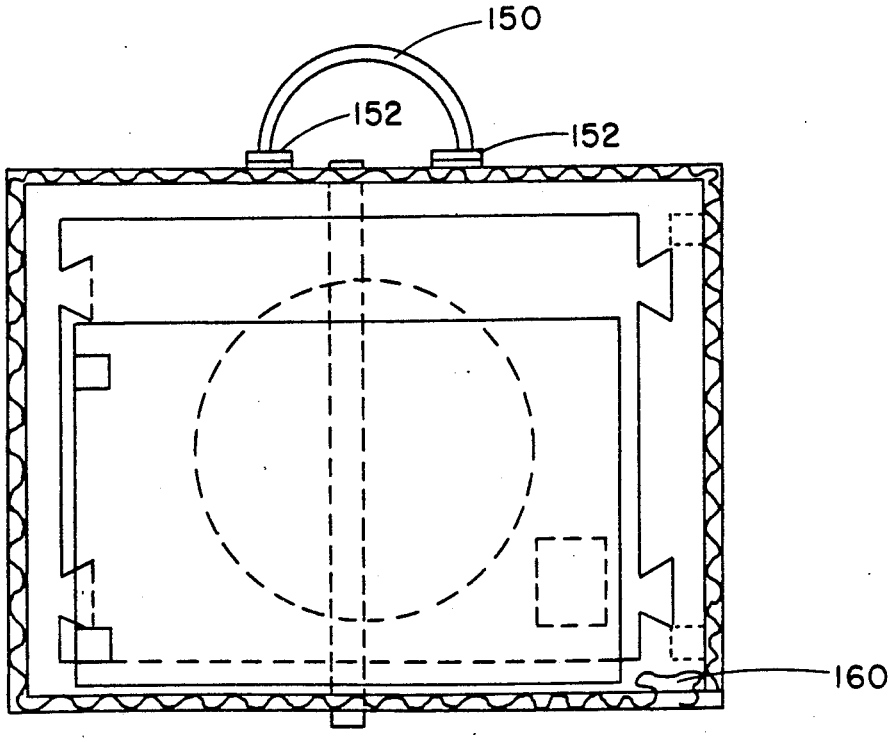
FIG. 10 is a cutaway front elevational view of the toilet in the kit form.

As shown in FIGS. 3 and 10, the collapsed toilet can be easily stored in the suitcase configuration and carried in the manner of a suitcase. The materials are indicated in FIG. 10 as being a corrugated type cardboard and thus are strong while still being light in weight. The midunit sections are shown in place inside the case, along with the cover unit 14. Any other materials, such as toilet paper, wipe-ups, and the like can also be contained in the closed container as shown in FIG. 10 by packet 160.

Figure 9:
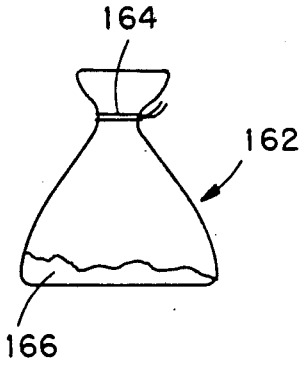
FIG. 9 is a side elevational view of a waste collection and disposal bag with desiccant gel contained therein.
Figure 4:
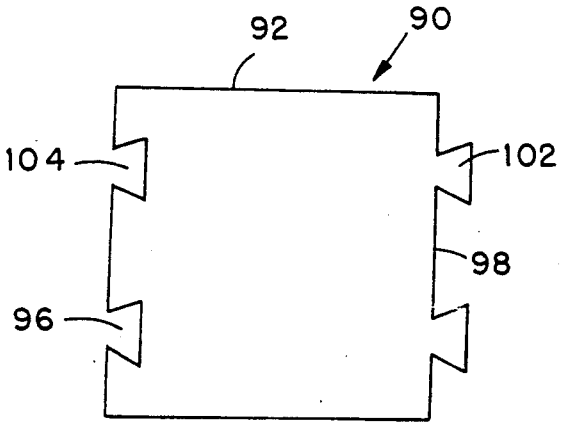
FIG. 4 is a top plan view of a midunit section.

Waste collection bags, such as flexible bag 162 shown in FIG. 9 are also contained in the case. Each bag 162 has a tie element 164 associated therewith for closing the bag after use for disposal, and a desiccant material 166 is included in the kit and is placed in the flexible bag before the bag is used. A tie is used to close the bag for disposal.

Assembly of the toilet is evident from the foregoing description of the various parts thereof, and thus will be presented only in a brief sketchy manner: The toilet is stored and transported in the FIG. 3 configuration, and the strap 154 is removed for set up. The bottom and top units are separated from each other, and the midunit is assembled using the joint connections 100 into the FIG. 5 form. This assembled midunit is attached to the bottom unit via the projection 108 and slot 140, and the top unit is slipped onto the midunit to be supported thereby. Desiccant is placed into a flexible bag, and the bag is then forced through the top opening 30 and attached to the top surface as by releasable adhesive, adhesive tape or the like. The cover unit 14 is then attached to the top unit via the hinges, and closed over the opening 30 until the toilet is to be used.

After use, the bag 162 is withdrawn from the toilet via the opening 30, tied closed using a tie 164, and disposed of.

The unit can then be knocked down, and reassembled into the case configuration shown in FIG. 3. Water repellent coatings, such as wax or the like, can be used on all inside surfaces of the various parts of the toilet if desired.

Figure 11:
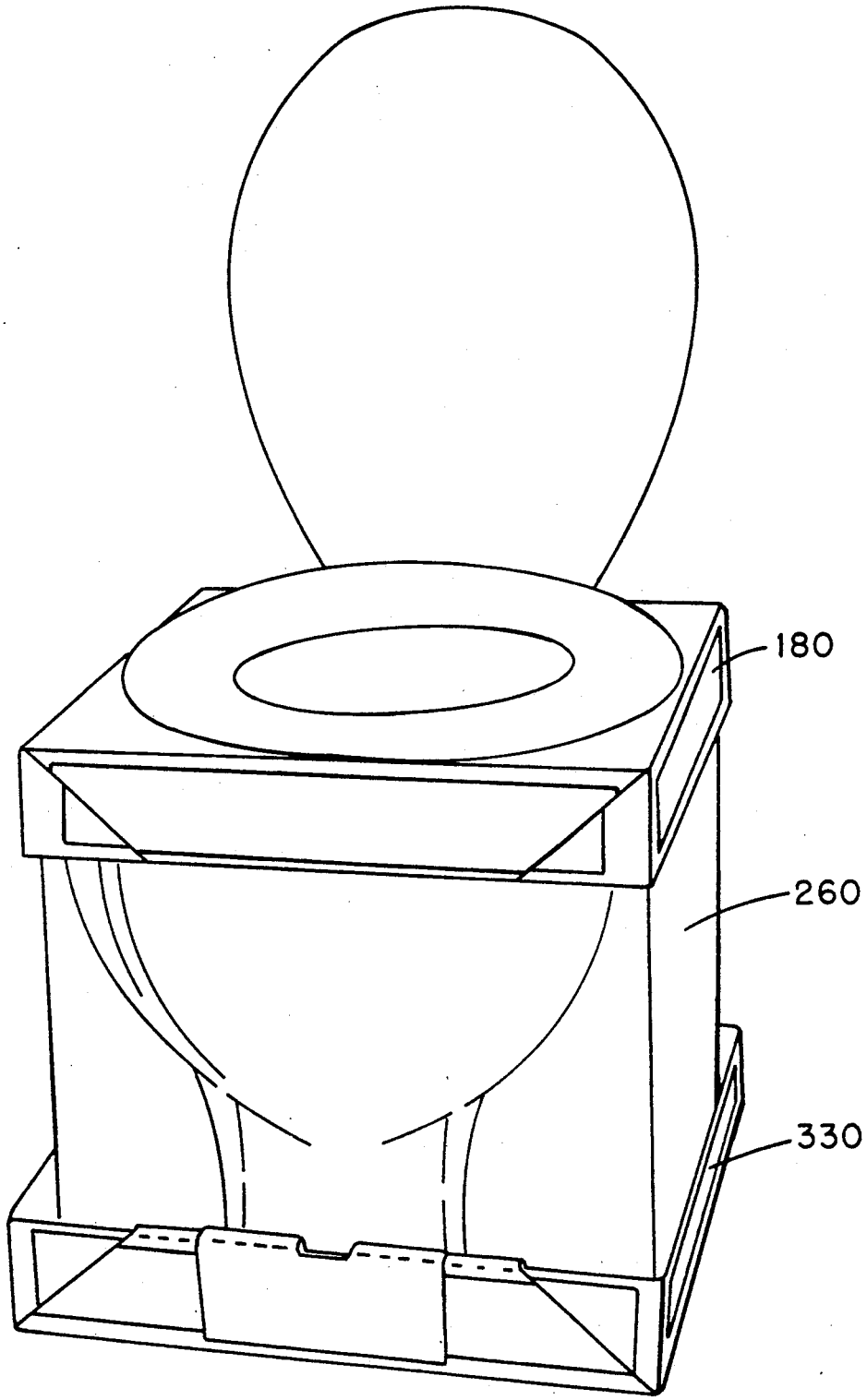
FIG. 11 is a perspective view of an alternative form of the portable toilet in which a seat and cover are attached to the top unit.
Figure 12:
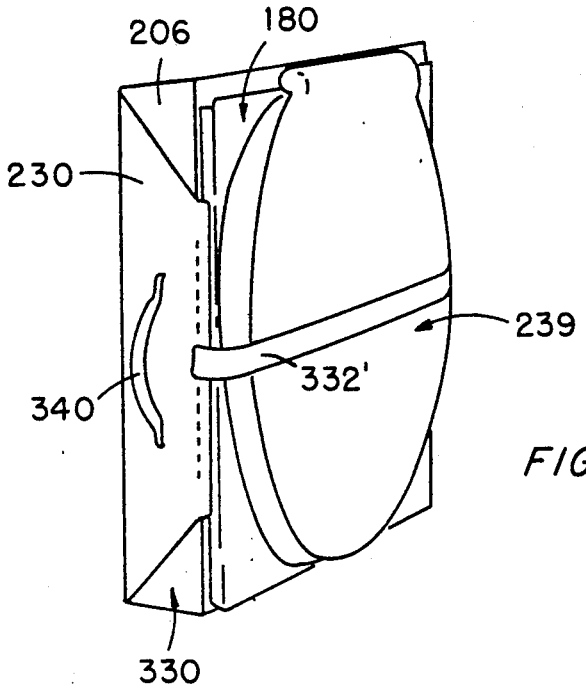
FIG. 12 is the alternative form of the toilet in the collapsed configuration.

An alternative form of the portable, knockdown toilet of the present invention is shown in FIGS. 11–19. This alternative form of the invention is similar to the just-described form in that it is collapsible into a kit form that is carried in the manner of a suitcase, as indicated in FIG. 12, and yet is easily set up for use as indicated in FIG. 11. The alternative form includes a plastic seat and seat cover as well as a slightly different midunit and an insert unit.

Figure 13:
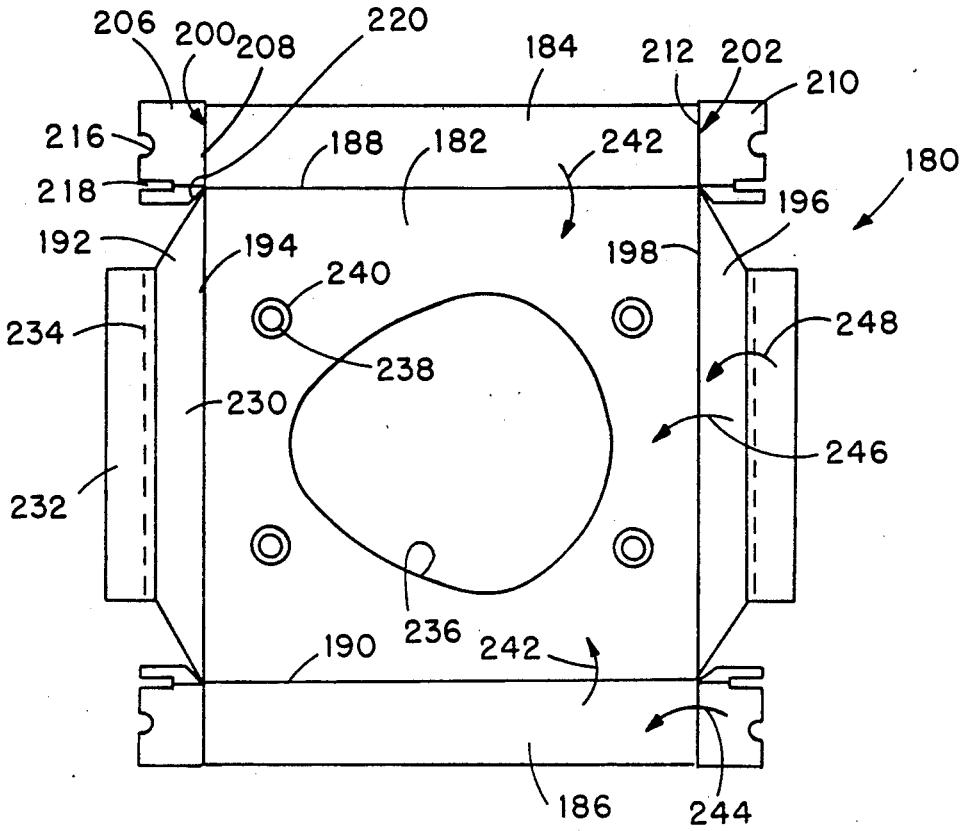
FIG. 13 is a bottom view of an unfolded top unit.
Figure 14:
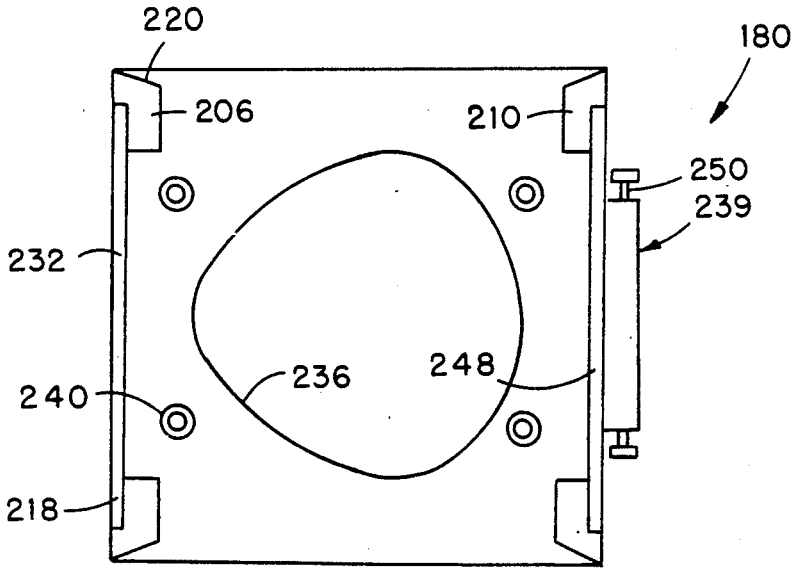
FIG. 14 is a bottom view of the top unit in the folded condition.

Referring to FIGS. 11, 13 and 14, the top unit of the alternative form of the toilet is indicated by reference numeral 180. The top unit 180 is monolithic, and includes a planar central section 182 having two side flanges 184 and 186 attached thereto by foldlines 188 and 190 respectively. The central section 182 is rectangular and has a front flap 192 foldably attached to a front edge thereof via a foldline 194 and a rear flap 196 foldably attached to a rear edge thereof via a foldline 198.

Each of the side flaps includes a front end 200 and a rear end 202 and has a front end flap 206 foldably attached to the front end via a foldline 208 and a end rear flap 210 foldably attached to the rear end via a foldline 212. Each end flap includes an arcuate notch 216 on a front end edge thereof and a slot 218 extending from the front end edge towards the side flap and stopping adjacent to the side flap to define a blind-ended slot. An angled edge 220 defines a rear end of the end flap.

The front and rear flaps each includes a first trapezoidal shaped flap portion 230 having a rectangular flap portion 232 attached thereto by a double foldline 234. A toilet opening shaped cutout 236 is defined centrally of the central portion 182, and fasteners, such as screw and nut fastener 238 attach a plastic toilet seat and cover combination 239 to the central section. Suitable washers, such as washer 240 are also used to ensure a secure attachment of the toilet seat and cover combination 239 to the top unit without danger of tearing the top unit.

In the set up condition of the top unit, the side flaps are folded inward as indicated by arrows 242 in FIG. 13, the end flaps are folded inward as indicated in FIG. 13 by arrow 244, and the end flaps are folded inward toward the central section as indicated in FIG. 13 by arrow 246. The rectangular sections are folded about double foldlines 234 in the direction of arrow 248 and are engaged with the end flaps 206 and 210 to secure the flaps in place through frictional engagement and material memory characteristics. The toilet seat and cover combination 239 has a hinge element 250 which attaches the seat to the cover and to the top unit in the manner of a toilet seat and cover assembly which permits the cover to be opened and closed while the seat remains in a fixed position attached to the top unit. The open position of the cover is shown in FIG. 11, while the closed position of that cover is shown in FIGS. 12 and 19.

Figure 15:
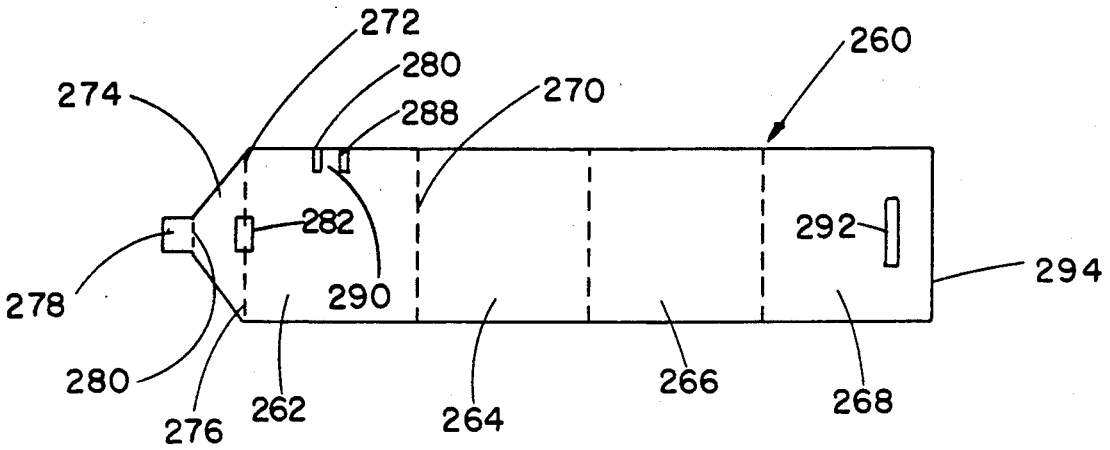
FIG. 15 is an rear elevational view of a midunit in the unfolded condition.
Figure 19:
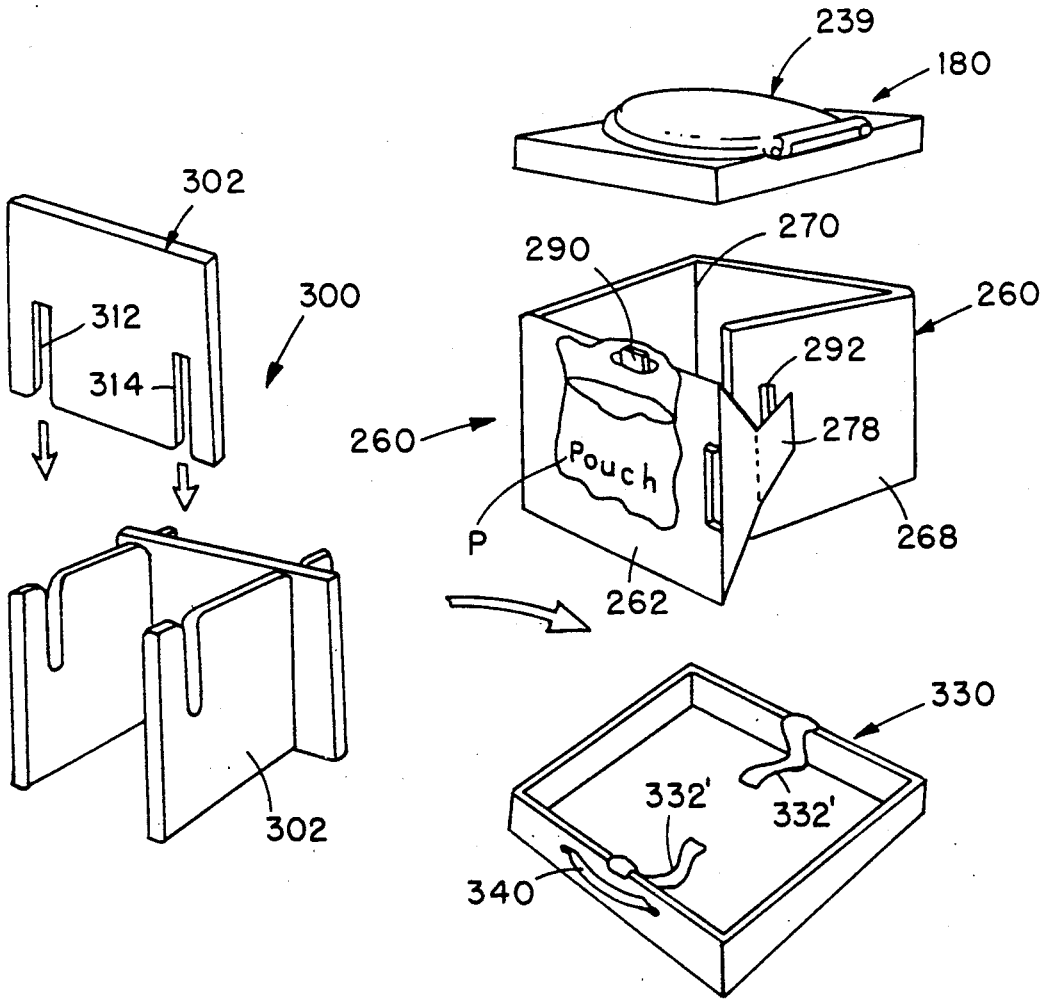
FIG. 19 is a schematic indicating the assembly of the alternative form of the toilet.

The alternative form of the toilet also includes a midunit 260, best shown in FIGS. 11, 15 and 19. As shown in those figures, the midunit 260 is monolithic, and includes four rectangular panels 262–268, connected to each other along end edges thereof via foldlines, such as foldline 270 foldably connecting one end edge of panel 262 to an adjacent end edge of panel 264. As shown in FIG. 15, panel 262 has a front end edge 272 to which is foldably attached a triangular flap 274 via a foldline 276. The triangular flap 274 has a rectangular front flap 278 attached thereto by a foldline 280 at an apex thereof, and has a slot 282 defined in the foldline 276. Two parallel blind-ended slots 286 and 288 are defined in the panel 262 and define a tab 290 on which a pouch P (see FIG. 19) is hung. This pouch contains toilet paper, desiccant, cleanups, bag ties and the like.

The panel 268 has a rectangular slot 292 defined therein near end edge 294 to receive the tab 278 and attach the panel 262 to the panel 268 and form the rectangular, tubular midunit 260 shown in FIG. 19. The midunit 260 has a peripheral size that is less than the peripheral size of the top unit so the top unit slidably fits over the midunit as indicated in FIG. 19 to have the top unit supported on top of the midunit.

Figure 16:
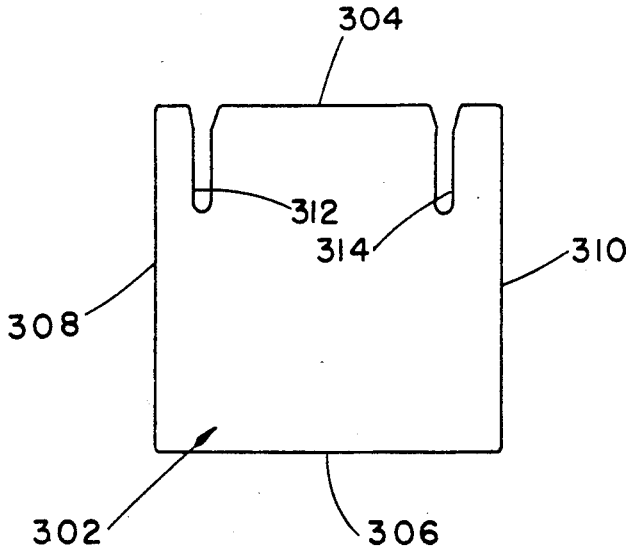
FIG. 16 is an elevational view of one panel of an insert unit.
Figure 17:
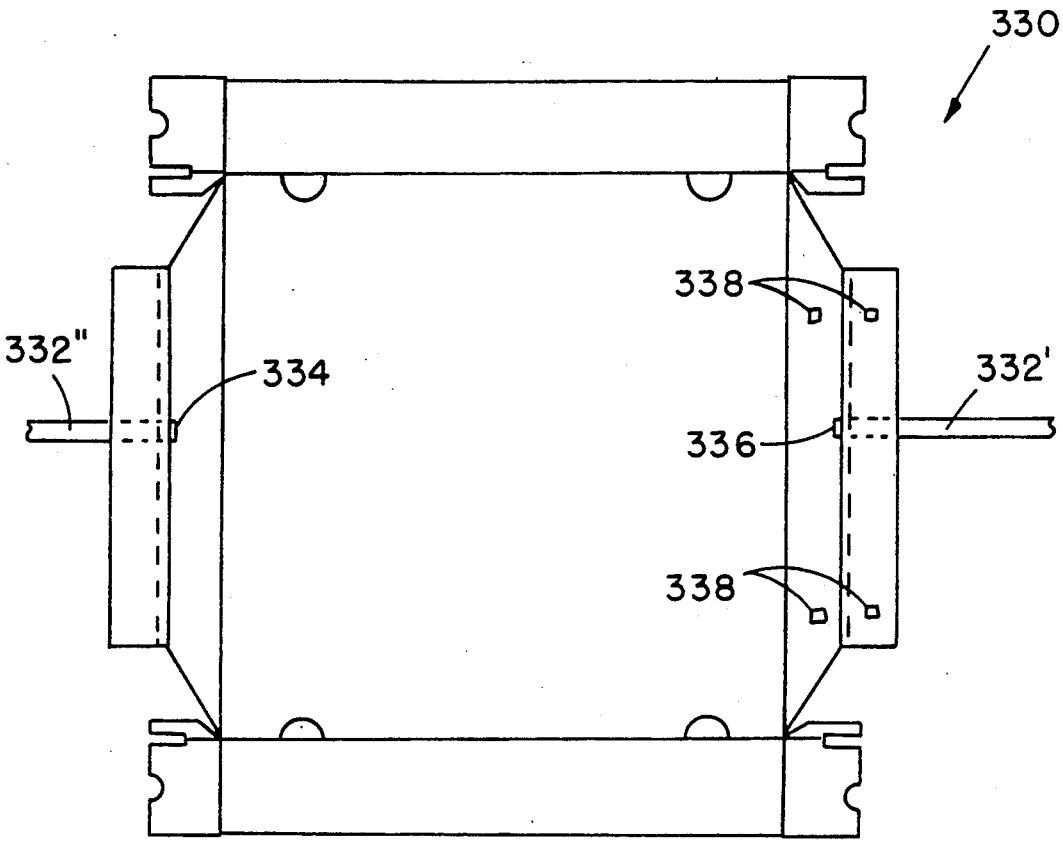
FIG. 17 is a bottom plan view of a bottom unit in an unfolded condition.

The alternative form of the toilet also includes an insert unit 300 shown in FIGS. 16 and 19 and located inside the midunit in the set-up condition of the device. The insert unit comprises four identical panels, such as panel 302 shown in FIG. 16. The panel 302 is rectangular in peripheral shape and includes an edge 304 which is a top edge in the set-up configuration, an edge 306 which is a bottom edge in the set-up configuration, and two side edges 308 and 310 connecting the top and bottom edges together. Two slots 312 and 314 are defined in the panel and extend from the top edge 304 toward the bottom edge and stop before reaching the bottom edge to define parallel blind-ended slots. As indicated in FIG. 19, adjacent panels 302 are interconnected by sliding one panel into a blind-ended slot of the adjacent panel. In the assembled condition, all of the panel top edges 304 are coplanar, and all of the panel bottom edges are coplanar with each other so the insert unit is stable. The insert unit has a height as measured between the top and bottom edges of the panels which matches the height of the midunit so the insert unit top edges will engage the bottom surface of the top unit and act as a further support for that unit in addition to the support provided thereto by the midunit which also engages the bottom surface of the top unit. The length of the panels as measured between the edges 308 and 310 is essentially equal to the length of a panel of the midunit as measured between adjacent foldlines 270 so that the insert unit fits snugly inside the midunit without moving about. This adds stability to the set-up device.

As is shown in FIGS. 11, 17, 18 and 19, the alternative form of the toilet also includes a bottom unit 330. The bottom unit 330 is similar to the top unit 180 with the exception that a tie strap and a handle element are attached to the bottom unit, and the bottom unit does not include a toilet opening similar to the opening 236 in the top unit. Otherwise, the flaps and panels are similar in both the top and bottom units.

The bottom unit 330 includes a strap slot 334 defined in one flap at the double fold through which a proximal end of strap portion 332' fits to be attached to the flap by a pintle-like connection or the like, and a second strap slot 336 defined in the other flap at the double fold and through which a proximal end 332" fits to be attached to that flap by a pintle-like connection or the like. Each of the strap portions 332' and 332" has a distal end which includes a hook-and-loop fastener means so the strap portions can be releasably attached together to secure the device in kit form as shown in FIG. 12.

Figure 18:
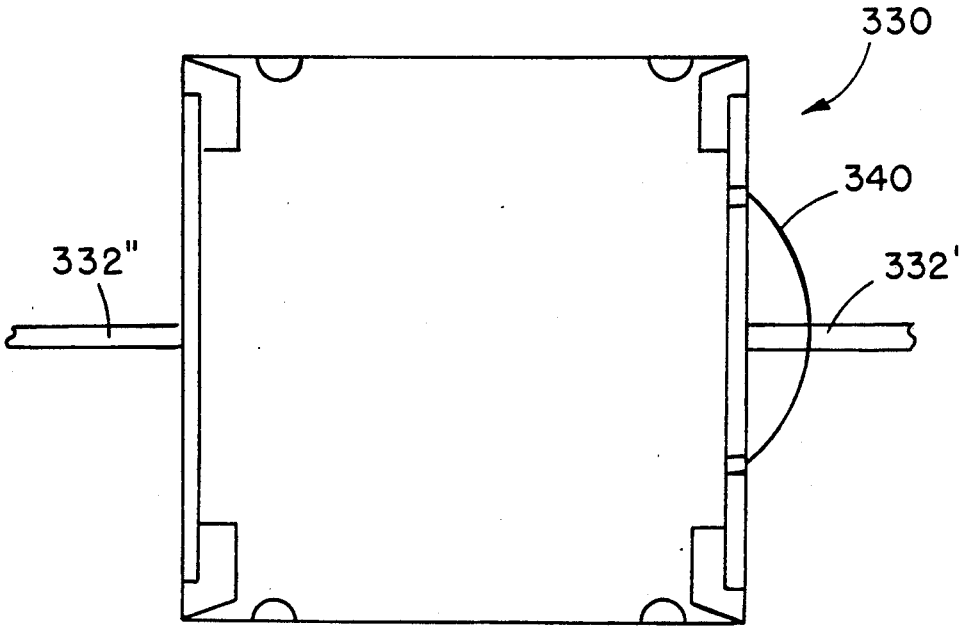
FIG. 18 is a bottom plan view of the bottom unit in the folded condition.

The bottom unit also includes two pairs of handle-accommodating holes 336 and 338 defined through the flaps to receive proximal ends of a handle element 340 shown in FIGS. 18 and 19, with that handle element being anchored to the bottom unit via pintle-like connections or the like.

Assembly of the alternative form of the toilet device is indicated in FIG. 19 and is self-evident from that figure. However, in the interest of completeness, such assembly will be briefly described. The kit is disassembled from the FIG. 12 condition by first releasing the strap distal ends, and removing the panels 302, the midunit 260, the pouch P, and the flexible bags 162 from inside the kit. The insert unit is assembled by slipping panels into the blind-ended slots of other panels. The insert unit is placed into the bottom unit after the straps 332' and 332" are placed inside that bottom unit as shown in FIG. 19. The midunit is then assembled by folding the panels along the foldlines 270 and inserting the tab 278 into the slot 292 to define the rectangular tube shown in FIG. 19. This assembled midunit is then placed in the bottom unit about the insert unit, and the pouch P is hung from the tab 290 as indicated. The top unit is then placed on top of the midunit and the insert unit, and the toilet is ready for use.

The top unit, the bottom unit and the midunit of both forms of the invention are monolithic. The insert unit of the second form of the invention is formed of monolithic panels. The monolithic nature of the various elements adds strength to the unit and makes manufacture thereof easier.

It is understood that while certain forms of the present invention have been illustrated and described herein, it is not to be limited to the specific forms or arrangements of parts described and shown.

What is claimed is:

1. A portable, knockdown toilet comprising:

A) a monolithic top unit which includes
  (1) a planar central section having an opening defined therethrough,
  (2) front and rear flanges depending from said central section,
  (3) two side flanges depending from said central section,
  (4) said top unit flanges cooperating with each other to define a top unit perimeter;

B) a monolithic bottom unit which includes
  (1) a planar central section,
  (2) front and rear flanges connected to said central section,
  (3) two side flanges connected to said central section,
  (4) said bottom unit flanges cooperating with each other to define a bottom unit perimeter which is essentially equal in size to said top unit perimeter, and
  (5) a handle mounting means on one of said bottom unit flanges,
  (6) a handle attached to said handle mounting means,
  (7) a securing strap means attached to said bottom unit;

C) a monolithic midunit which includes
  (1) four essentially identical sections defined by folding said midunit along foldlines to define two outer sections and two inner sections, each of which includes
    (a) a rectangular perimeter having a top edge, a bottom edge, a first side edge and a second side edge,
    (b) a tab extending from a foldline on said first side edge of one of said outer sections,
  (2) a slot defined in the other of said outer sections for receiving said tab;

D) a waste collection bag removably securable within said opening;

E) an insert unit for supporting said top unit and located within said midunit, said insert including four essentially identical monolithic rectangular panels, with each panel including a two blind-ended slots defined therein near an edge of said panel said panels being connected together by slidably connecting each panel in respective slots to form a rectangular configuration;

F) whereby when said toilet is in a knockdown position said top unit flanges being located to contact said bottom unit flanges for forming a kit, said top unit cooperating with said bottom unit to define a carrying case, said carrying case being sized to contain said midunit sections and said insert unit panels, as well as said waste collection bag in a kit form.

2. The portable, knockdown toilet defined in claim 1 further including a toilet seat and a toilet seat cover, mounted on said top unit.

3. The portable, knockdown toilet defined in claim 2 further including fastening means attaching said toilet seat and toilet seat cover to said top unit.

4. The portable, knockdown toilet defined in claim 3 wherein said top unit includes a rectangular tab on two of said flanges and end panels on two other of said flanges.

5. The portable, knockdown toilet defined in claim 4 wherein said top unit further includes blind-ended slots defined in said end panels, with said end panels being connected to said flanges by foldlines, and said rectangular tab being connected to said flange by a foldline.

6. The portable, knockdown toilet defined in claim 5 wherein said bottom unit includes a bottom unit rectangular tab on two of said bottom unit flanges and bottom unit end panels on two other of said bottom unit flanges.

7. The portable, knockdown toilet defined in claim 6 wherein said bottom unit further includes bottom unit blind-ended slots defined in said bottom unit end panels, with said bottom unit end panels being connected to said bottom unit flanges by foldlines, and said bottom unit rectangular tab being connected to said bottom unit flange by a foldline.

8. The portable, knockdown toilet defined in claim 7 wherein said insert unit panels are each monolithic and each include blind-ended slots.

9. The portable, knockdown toilet defined in claim 8 wherein said midunit includes a plurality of panels each connected to an adjacent panel by a foldline.

10. The portable, knockdown toilet defined in claim 9 wherein said midunit further includes two parallel slots in one of said panels defining a tab therebetween.

* * * * *